US008407946B1

(12) United States Patent
Aaron

(10) Patent No.: US 8,407,946 B1
(45) Date of Patent: Apr. 2, 2013

(54) CLOSET LINER

(76) Inventor: Steven A. Aaron, Farmington, MN (US)

( * ) Notice: Subject to any disclaimer, the term of this patent is extended or adjusted under 35 U.S.C. 154(b) by 26 days.

(21) Appl. No.: 13/207,268

(22) Filed: Aug. 10, 2011

(51) Int. Cl.
*E04B 1/346* (2006.01)

(52) U.S. Cl. ..... 52/71; 52/36.2; 52/656.1; 312/258; 446/478

(58) Field of Classification Search ..... 52/64, 70, 52/71, 36.1, 362, 36.4, 36.5, 79.1, 79.5, 79.9, 52/656.1, 234, 238.1, 239, 283, 284, 262; 446/476, 477, 487, 488, 478; 312/257.1, 312/262, 265.4, 265.5, 270.2, 204, 238, 239, 312/242, 258, 270.1
See application file for complete search history.

(56) References Cited

U.S. PATENT DOCUMENTS

| | | | | | |
|---|---|---|---|---|---|
| 1,059,023 | A | | 4/1913 | Berry | |
| 1,166,572 | A | | 1/1916 | Bardwell | |
| 1,188,974 | A | | 6/1916 | Montgomery | |
| 1,918,375 | A | * | 7/1933 | Bowersock et al. | 52/71 |
| 2,837,777 | A | * | 6/1958 | White | 52/27 |
| 2,963,122 | A | * | 12/1960 | Jagemann | 52/66 |
| 3,294,464 | A | * | 12/1966 | Lew | 312/258 |
| 3,425,763 | A | | 2/1969 | De Lynn | |
| 3,835,586 | A | | 9/1974 | Gates | |
| 4,035,964 | A | * | 7/1977 | Robinson | 52/66 |
| 4,467,572 | A | * | 8/1984 | Somers et al. | 52/70 |
| 5,212,926 | A | | 5/1993 | Beasley | |
| 5,319,903 | A | * | 6/1994 | Holland | 52/79.1 |
| 5,813,174 | A | * | 9/1998 | Waller | 52/79.1 |
| 5,975,660 | A | * | 11/1999 | Tisbo et al. | 312/263 |
| 6,108,982 | A | * | 8/2000 | Davison | 52/64 |
| 6,178,701 | B1 | * | 1/2001 | De Paepe et al. | 52/36.2 |
| 6,553,725 | B2 | * | 4/2003 | Washington | 52/64 |
| 6,722,750 | B2 | * | 4/2004 | Chan | 312/258 |
| 6,948,787 | B2 | * | 9/2005 | McBrayer et al. | 312/258 |
| 2009/0272043 | A1 | * | 11/2009 | Zwern | 52/27 |

* cited by examiner

*Primary Examiner* — Brian Glessner
*Assistant Examiner* — Beth Stephan
(74) *Attorney, Agent, or Firm* — Steven E. Kahm

(57) ABSTRACT

A self-supporting, folding closet liner assembly for a closet that is both functional and decorative. The assembly is made up of two sets of hinged folding panel assemblies; a wall panel assembly to form the self-supporting, finished, vertical surfaces of the closet and door jamb, and a top panel assembly to form the ceiling, the horizontal upper portion of the door jamb, and the section of vertical wall between the ceiling and the horizontal upper portion of the door jamb. The folding closet liner assembles fold flat for shipping and unfold in the closet for easy assembly.

6 Claims, 6 Drawing Sheets

CLOSET LINER

BACKGROUND OF THE INVENTION

1. Field of the Invention

The present invention relates to finishing the interior of a room (such as a closet) along with said room's door jamb, and more particularly, to finishing a room and door jamb by unfolding a self-supporting panel assembly.

2. Description of the Related Art

Finishing the interior and door jamb surfaces of a room within a building typically involves considerable labor. Small rooms, in particular, have a disproportionately large amount of labor per square foot compared to larger rooms because they typically have the same number of corners and other labor intensive aspects as a large room, without the square footage of a large room. Finally, small rooms such as a closet, unlike larger rooms such as a bedroom, often have additional labor-intensive finishing requirements like the installation of shelves, hanger rods, and bi-fold doors.

SUMMARY OF THE INVENTION

In accordance with the present invention, there is provided a self-supporting, folding room finishing assembly that is both functional and decorative. The assembly is made up of two sets of hinged folding panels; one set of hinged panels forms the self-supporting, finished, vertical surfaces of the room and door jamb, and the other set of hinged folding panels forms the ceiling, the horizontal upper portion of the door jamb, and the section of vertical wall between the ceiling and the horizontal upper portion of the door jamb.

Each of the two sets of panels contains multiple panels which are joined to each other by hinges which allow the panels to fold flat, so that the planar surfaces of each panel are touching when folded flat.

The two sets of hinged folding panels are designed to fit together in an interlocking fashion, and the two sets of hinged panels are joined to each other through a simple locking mechanism, thus forming a complete inner lining of a room and door jamb, which will firmly stand upright and maintain overall shape when fully unfolded and joined.

OBJECTS OF THE INVENTION

It is an object of the invention to provide a labor-saving assembly for finishing the interior surfaces of a room and door jamb.

It is an object of the invention to provide a room finishing assembly that is self-supporting.

It is an object of the invention to provide a room finishing assembly that folds flat for shipping.

It is an object of the invention to provide a room finishing assembly that includes mechanisms to attach shelves and hanger bars.

It is an object of the invention to provide a room finishing assembly that includes a door jamb.

It is an object of the invention to provide a room finishing assembly that includes a self-supporting door jamb.

Other objects, advantages and novel features of the present invention will become apparent from the following description of the preferred embodiments when considered in conjunction with the accompanying drawings.

DESCRIPTION OF THE PREFERRED EMBODIMENT

Figure 1:
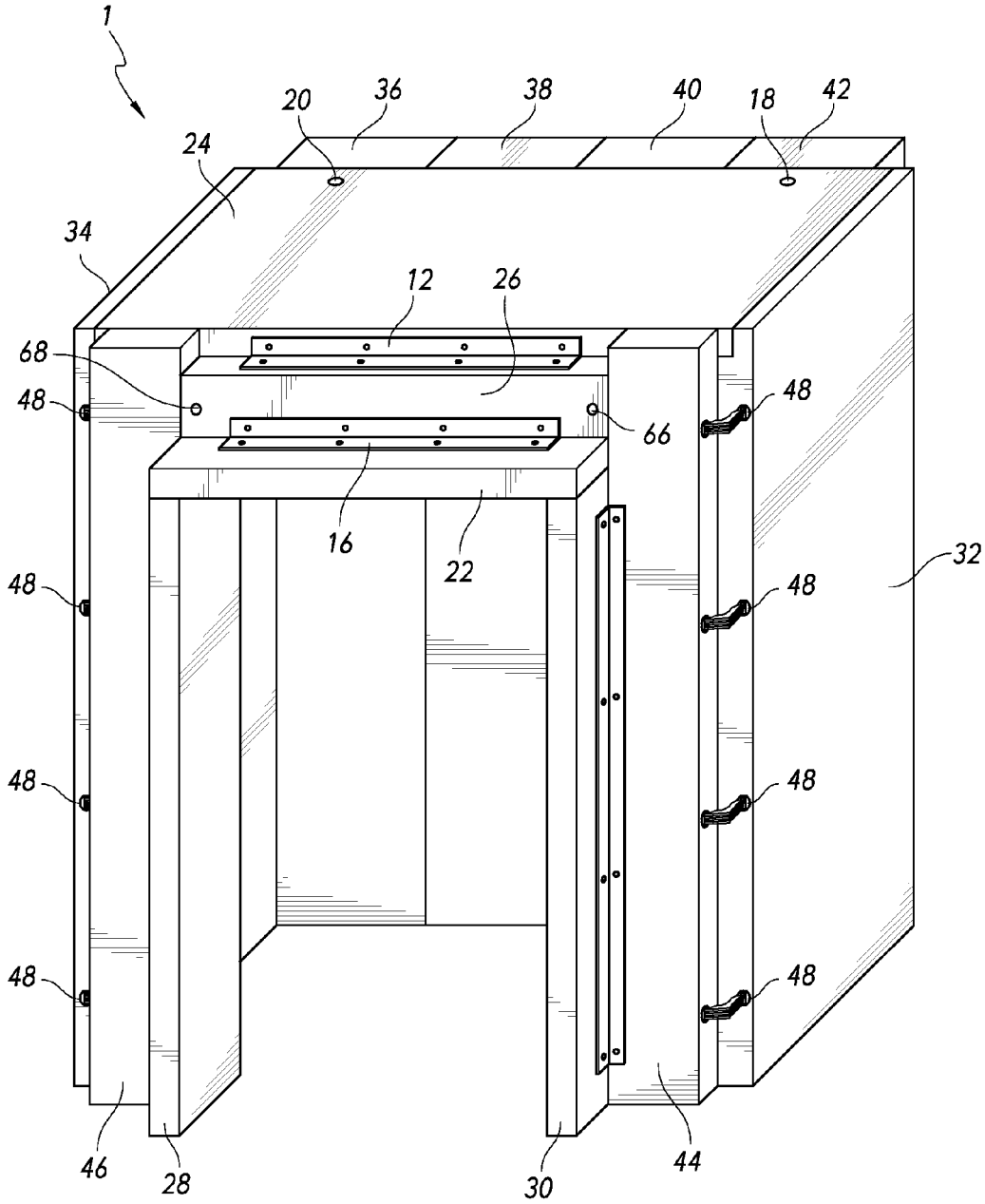
FIG. 1 is a front perspective view of the fully installed room finishing assembly.
Figure 2:
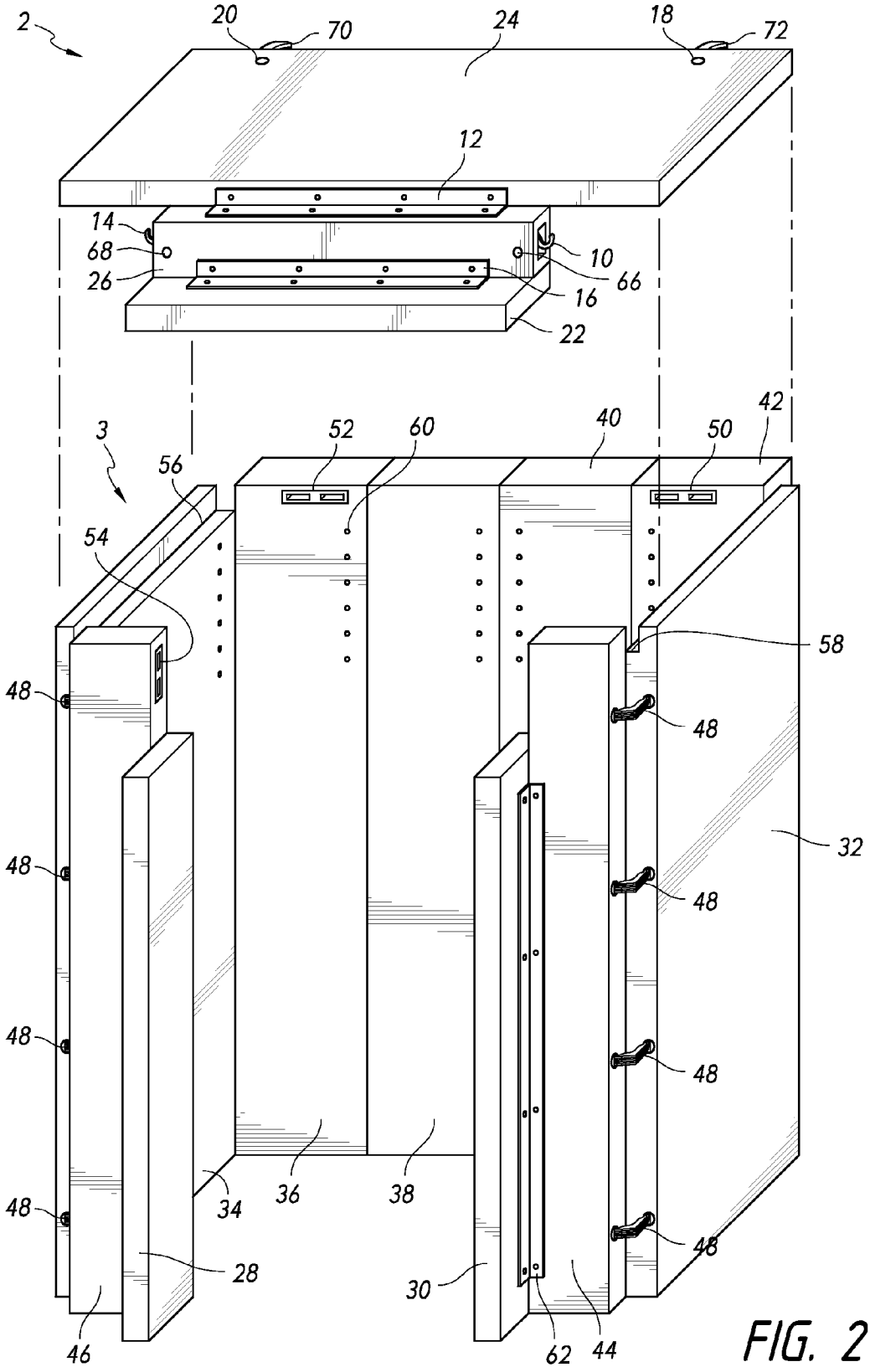
FIG. 2 is a front perspective view of the two main components of the device, with the top panel assembly exploded from the main vertical panel assembly.

FIG. 1 is a front perspective view of the fully assembled Closet Liner 1, in accordance with the invention. The Closet Liner 1 may be fabricated of wood, plastic, metal, or any other suitable material. The hinges and locking mechanisms shown can be of any design which allows for the functions described in accordance with the invention. The vertical wall panel hinge 48 shown in FIG. 1 is a barrel style hinge which is installed into the edges of the vertical wall panels. The accessory mounting point 60 modifications shown can be of any form that facilitates the attachment of accessories such as shelves or hanger rods without impinging on the functions described in accordance with the invention. In this embodiment, the accessory mounting point 60, shown in FIG. 2, is a simple pre-drilled hole which can be used to attach shelf support pins. Other accessory mounting point 60 usage examples include, but are not limited to, hanger rod attachments.

FIG. 2 is a front perspective view of the two main components of the Closet Liner 1, with the top panel assembly 2 shown detached from and above the wall panel assembly 3. In this view the left-front locking mechanism receiver 54 is exposed near the top of the left front vertical side wall panel 46. This locking mechanism receiver 54 provides a secure attachment point for the rotating latch portion of the left-front locking mechanism 14 on the top panel assembly 2. Similarly, the left-rear locking mechanism receiver 52 and right-rear locking mechanism receiver 50 are shown at the top of rear vertical wall panel 36 and rear vertical wall panel 42, respectively. This view also shows the right vertical jamb hinge 62 in a fully unfolded 90 degree position. The right vertical jamb hinge 62 as shown is a standard piano hinge style and provides a simple surface mount hinge that allows for a 90 degree rotation of the right vertical jamb 30 with respect to the right-front vertical wall panel 44 The left vertical jamb hinge 64 is obscured but can be seen in a fully folded position in FIG. 3 and a partially folded position in FIG. 4.

Figure 3:
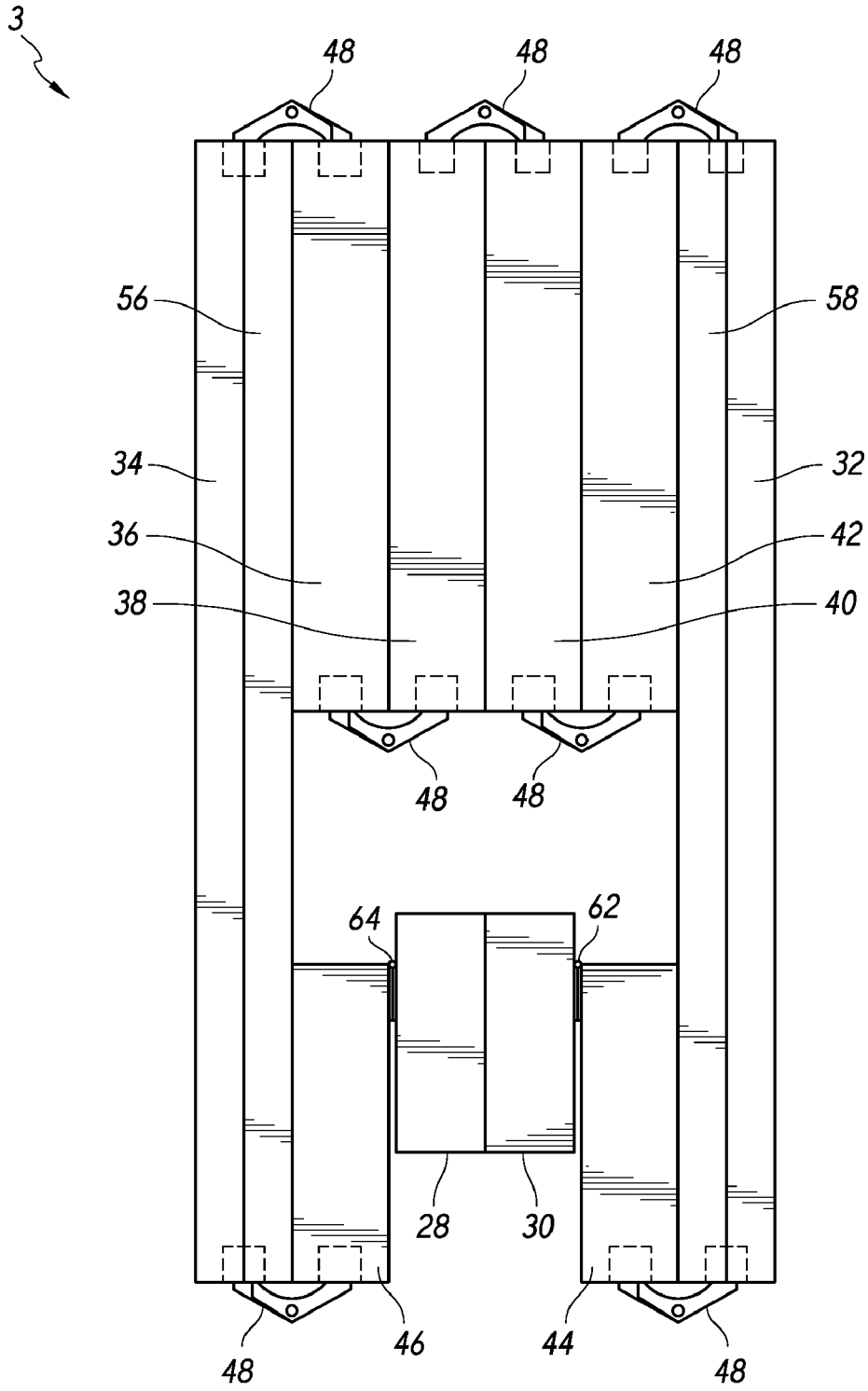
FIG. 3 is a top view of the main vertical panel assembly in a fully folded and ready-for-shipment position.

FIG. 3 is a top view of the wall panel assembly 3 in a fully folded and ready-for-shipment position. This is the position used for shipping the wall panel assembly 3 as well as the position used for positioning the wall panel assembly 3 inside the closet for deployment. The number of panels and the thickness of the panels are such that when the wall panel assembly 3 is fully folded for shipping, there are no gaps between planar surfaces of the panels, including the inner planar surfaces of the left vertical jamb panel 28 and the right vertical jamb panel 30. The rear vertical wall panels (rear vertical wall panel 36, rear vertical wall panel 38, rear vertical wall panel 40, and rear vertical wall panel 42) do not need to be the same width from left to right, but they must be so wide that they can be folded flat without overlapping on the left vertical wall panel 34, the right vertical wall panel 32, the left vertical jamb panel 28 or the right vertical jamb panel 30 as any such overlap would prevent the wall panel assembly 3 from folding flat for shipping. The wall panel assembly 3 must be maneuvered through the door opening of the closet by tilting the top of the folded wall panel assembly 3 under the top edge of the door opening, and then sliding the base of the wall panel assembly 3 into the closet. The wall panel assembly 3 will be ready for unfolding once it is fully vertical inside the closet and perpendicular to the floor. The width, height, and depth of the fully assembled Closet Liner 1 must be slightly less than the respective dimensions of the interior surfaces of the closet in which the Closet Liner 1 will be unfolded and assembled in order to allow the device to be fully unfolded as well as to allow room for the top panel assembly 2 to be maneuvered into position above the wall panel assembly 3.

Figure 4:
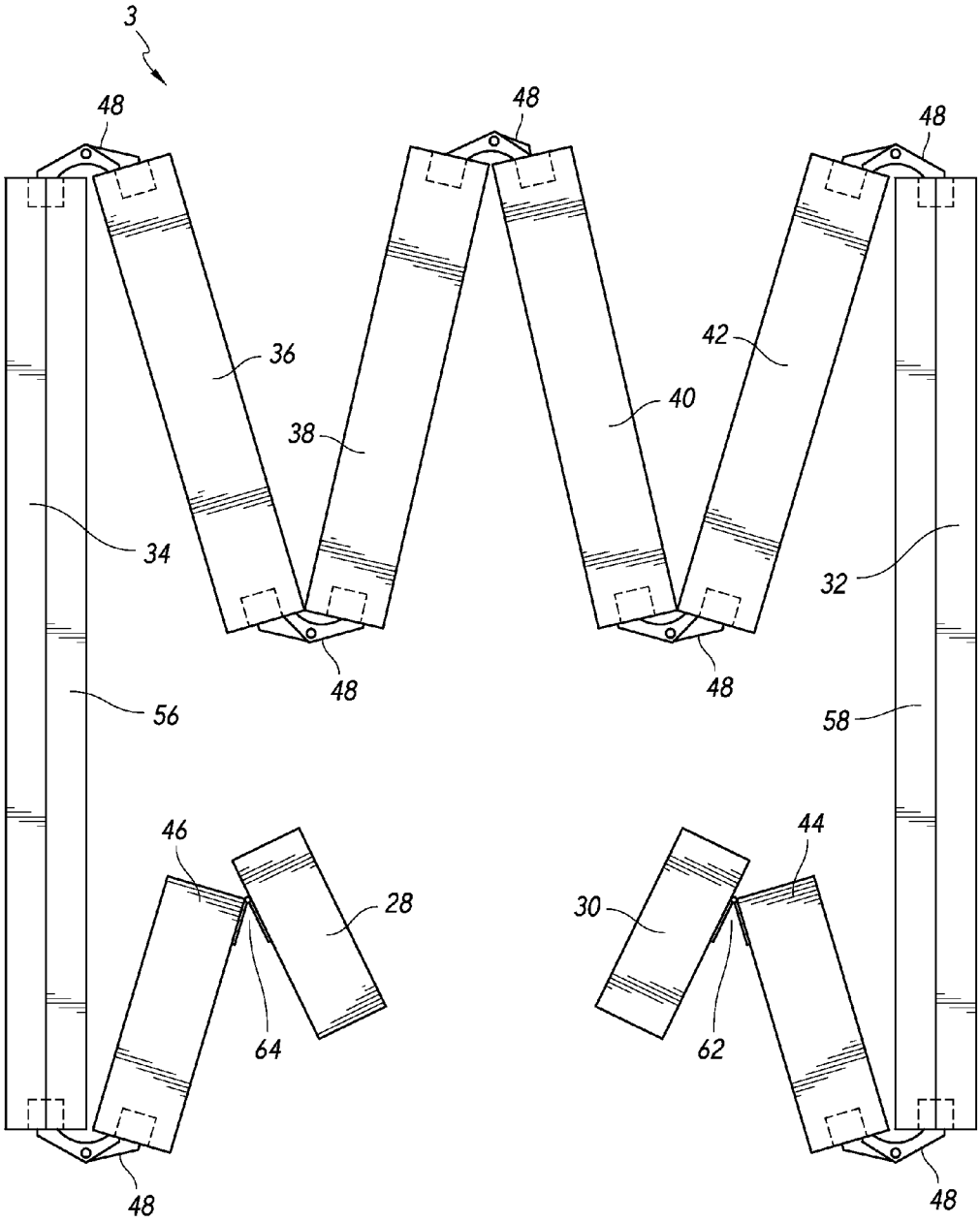
FIG. 4 is a top view of the main vertical panel assembly in a partially unfolded position.

FIG. 4 is a top view of the wall panel assembly 3 in a partially unfolded position. By sliding the left vertical wall panel 34 toward the left side of the closet, and the right vertical wall panel 32 toward the right side of the closet, the wall panel assembly 3 can be fully unfolded and positioned within the closet and door jamb interior until it has reached the fully unfolded position as shown in the fully unfolded view of the wall panel assembly 3 in FIG. 2.

Figure 5:
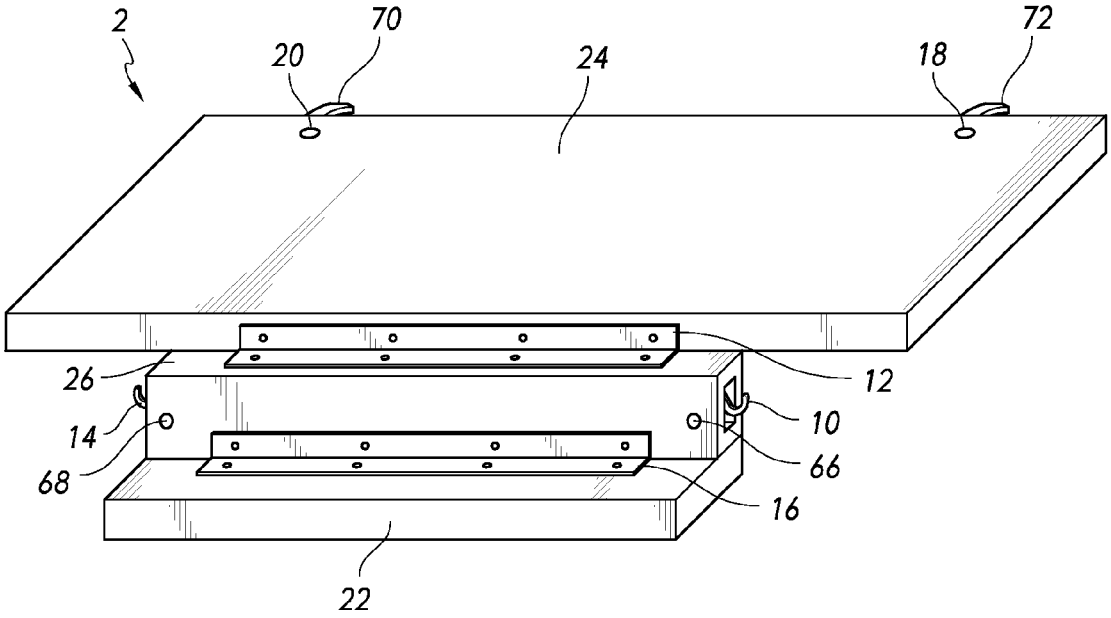
FIG. 5 is a front perspective view of the fully unfolded top panel assembly.

FIG. 5 is a front perspective view of the fully unfolded top panel assembly 2. This view highlights the ceiling panel hinge 12 which holds the vertical top panel 26 to the ceiling panel 24. This hinge also allows the vertical top panel 26 to fold flat against the ceiling panel 24 for shipping as shown in the fully folded view of the top panel assembly 2 in FIG. 6B. Similarly, the horizontal jamb hinge 16 holds the horizontal jamb panel 22 to the vertical top panel 26 and allows the horizontal jamb panel 22 to fold flat against the vertical top panel 26 for shipping. These two hinges are the same piano style and function as used for the right vertical jamb hinge 62 and left vertical jamb hinge 64. Also shown in this view are the 4 locking mechanisms 10, 14, 70, 72 used for securing the top panel assembly 2 to the wall panel assembly 3 once the top panel assembly 2 is fully unfolded and securely resting in position with the left end of the ceiling panel 24 resting squarely in the left vertical wall top notch 56 and the right end of the ceiling panel 24 resting squarely in the right vertical wall top notch 58 as seen with the fully assembled Closet Liner 1 shown in FIGS. 1 and 2. The locking mechanisms are a means of securing and drawing tight the top panel assembly 2 to the wall panel assembly 3. In this embodiment, the locking mechanisms are of the rotating draw latch style and are rotated using a standard hex screwdriver inserted into the right-front locking mechanism access hole 66, the left-front locking mechanism access hole 68, the right-rear locking mechanism access hole 18, and the left-rear locking mechanism access hole 20. In this embodiment of the device, the right-front locking mechanism 10 and left-front locking mechanism 14 are used to secure the vertical top panel 26 to the right-front vertical wall panel 44 and the left-front vertical wall panel 46, respectively. Also in this embodiment of device, the right-rear locking mechanism 72 and left-rear locking mechanism 70 are used to secure the ceiling panel 24 to the left-rear locking mechanism receiver 52 in the rear vertical wall panel 42 and the right-rear locking mechanism receiver 50 in the rear vertical wall panel 36, respectively.

Figure 6A:
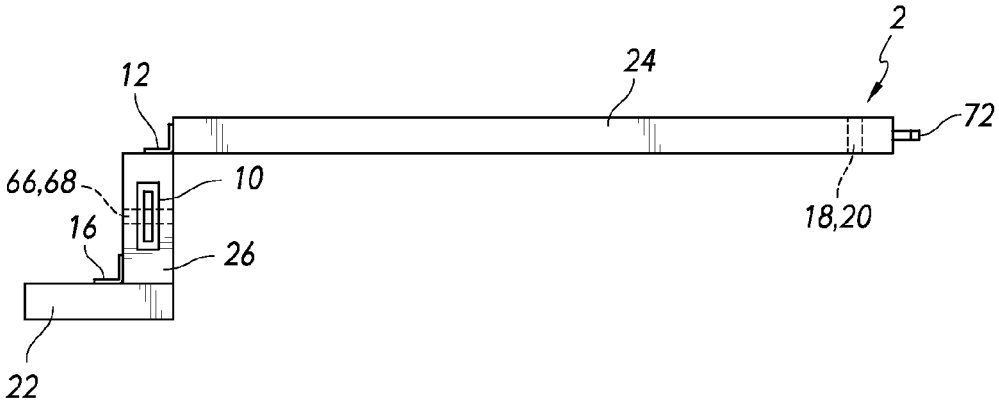
FIG. 6A is a right side view of the top panel assembly in fully unfolded position.
Figure 6B:
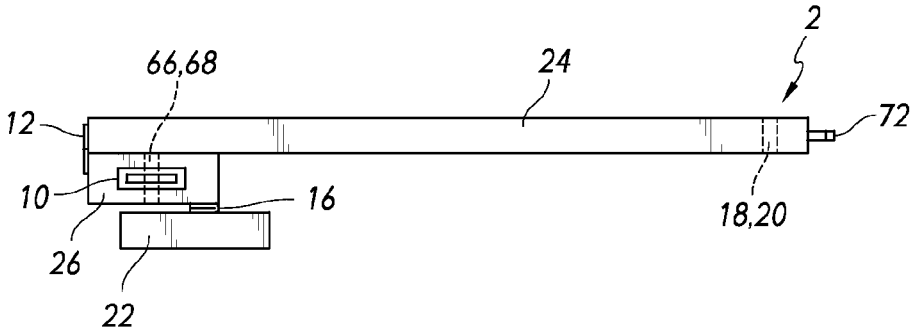
FIG. 6B is a right side view of the top panel assembly in fully folded, position.
Figure 6C:
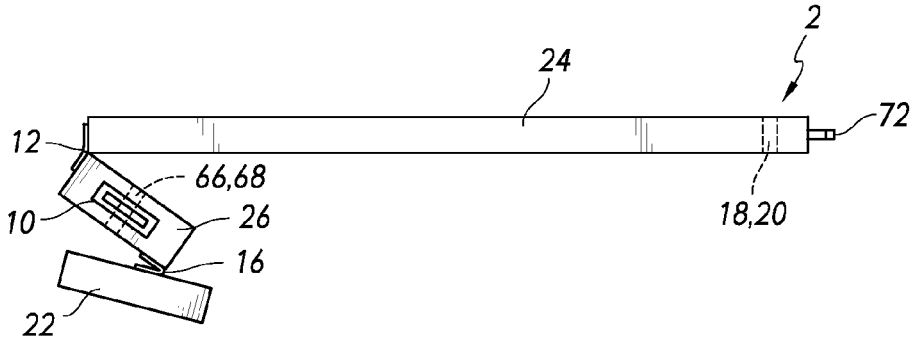
FIG. 6C is a right side view of the top panel assembly in partially folded position.

FIG. 6A is a right side view of the top panel assembly 2 in the fully unfolded position. FIG. 6B is a right side view of the top panel assembly 2 in the fully folded position. FIG. 6C is a right side view of the top panel assembly 2 in a partially unfolded position. These views illustrate how the top panel assembly 2 can be unfolded once it is securely resting in position with the left end of the ceiling panel 24 resting squarely in the left vertical wall top notch 56 and the right end of the ceiling panel 24 resting squarely in the right vertical wall top notch 58, as shown in the fully assembled Closet Liner 1 shown in FIG. 1.

What is claimed is:

1. A closet liner for finishing the interior walls, ceiling and door jamb of a small room, comprising:

a wall panel assembly having a plurality of stand-alone rear wall panels, each rear wall panel having vertical sides with at least one hinge connected to each vertical side connecting the rear wall panels to each other, to form a rear wall of the wall panel assembly, a stand-alone left side wall panel having vertical sides with a first hinge on one of the vertical sides connected to a vertical side one of the vertical sides of one of the rear wall panels, and having a second hinge on the other vertical side of the left side panel connected to a stand-alone left front wall panel, the left front wall panel having vertical sides and having a left door jamb connected thereto by a hinge on the left front wall panel, a stand-alone right side wall panel having vertical sides with a first hinge on one of the vertical sides connected to one of the vertical sides of one of the rear wall panels, and having a second hinge on the other vertical side of the right side panel connected to a stand-alone right front wall panel, the right front wall panel having vertical sides and having a right door jamb connected thereto by a hinge on the right front wall panel, a top panel assembly having a stand-alone ceiling panel having a length and width the same as at least the interior perimeter length and width of the wall panel assembly with a first hinge on one edge connected to a stand-alone vertical top panel, the vertical top panel having a second hinge on a side opposite the first hinge connected to a stand-alone horizontal door jamb, the top panel assembly connected to the top of the wall panel assembly, wherein when the top panel assembly and the wall panel assembly are assembled the right door jamb, the left door jamb and the horizontal door jamb form the perimeter of a door in the closet liner.

2. A closet liner for finishing the interior walls, ceiling and door jamb of a small room, as in claim 1 having, a locking mechanism in the rear wall and in the ceiling panel for connecting the top panel assembly to the wall panel assembly.

3. A closet liner for finishing the interior walls, ceiling and door jamb of a small room, as in claim 2 having, a locking mechanism in the front wall panels and in the vertical top panel for connecting the top panel assembly to the wall panel assembly.

4. A closet liner for finishing the interior walls, ceiling and door jamb of a small room, as in claim 1 having a notch on the top of the side wall panels for accepting the ceiling panel.

5. A closet liner for finishing the interior walls, ceiling and door jamb of a small room, as in claim 2, having a notch on the top of the side wall panels for accepting the ceiling panel.

6. A closet liner for finishing the interior walls, ceiling and door jamb of a small room, as in claim 3 having a notch on the top of the side wall panels for accepting the ceiling panel.

* * * * *